United States Patent [19]

Fisher et al.

[11] 4,367,351

[45] Jan. 4, 1983

[54] HIGH DENSITY FUEL COMPOSITIONS

[75] Inventors: Dennis H. Fisher, Westerville, Ohio; Steven C. Howe, Big Spring, Tex.; Richard L. Linard, Dublin, Ohio

[73] Assignee: Ashland Oil, Inc., Ashland, Ky.

[21] Appl. No.: 279,412

[22] Filed: Jul. 1, 1981

[51] Int. Cl.[3] ..... C10L 1/04

[52] U.S. Cl. ..... 585/14; 585/22; 585/360; 149/109.4; 149/109.6; 149/120

[58] Field of Search ..... 585/14, 22, 360; 149/109.4, 109.6, 120

[56] References Cited

U.S. PATENT DOCUMENTS

| | | | |
|---|---|---|---|
| 3,113,424 | 12/1963 | Wineman | 585/14 |
| 4,087,257 | 5/1978 | Burdelle | 585/14 |
| 4,177,217 | 12/1979 | Janoski et al. | 585/14 |
| 4,275,254 | 6/1981 | Schneider et al. | 585/14 |
| 4,286,109 | 8/1981 | Norton et al. | 585/14 |

*Primary Examiner*—Jacqueline V. Howard

*Attorney, Agent, or Firm*—William Kammerer

[57] ABSTRACT

A high density specialty fuel for propelling limited volume ramjet and turbojet missile systems comprising a blend of at least 70 weight percent of exotetrahydrodicyclopentadiene and a correspondingly minor amount of a combination of a mixture of $C_5$–$C_7$ alkanes and/or cycloalkanes and hydrogenated dimers of norbornadiene.

4 Claims, No Drawings

HIGH DENSITY FUEL COMPOSITIONS

BACKGROUND OF THE INVENTION

1. Field of the Invention

This invention relates to synthetically derived high density liquid hydrocarbon fuels.

2. Description of the Prior Art

High density liquid hydrocarbon fuels are characterized in having a net volumetric heat of combustion in excess of about 140,000 BTU per gallon. A high density or energy fuel is essentially required for fueling turbojet and ramjet propelled limited volume missile systems. Beyond the need for a high energy content in order to maximize range performance of the missile, there are other requirements in the forefront depending, in the main, on the manner in which the missile is to be deployed. For instance, in the airborne deployment of a missile where the latter is carried exteriorly of the aircraft, the fuel must exhibit the combination of a very low freeze point and high volatility.

A high density fuel of the foregoing type does not occur in nature but rather must be chemically synthesized. Essentially all of the current generation of such fuels commonly feature a norbornane moiety having an additional cyclic hydrocarbon appendage. Such appendages include the norbornane structure itself in the case of the most exotic of these fuels designated RJ-5; viz., dihydro di (norbornadiene), otherwise referred to as the hydrogenated dimers of norbornadiene. In some instances only a specific stereo isomer of the synthesized compound represents a suitable fuel from the standpoint of having the requisite physical properties. A notable example of this is JP-10 which chemically is the exostereo isomer of tetrahydrodicyclopentadiene.

In missile launching situations calling a low temperature operational capability as noted above, the foremost fuel of choice is said JP-10. This is so because JP-10 is derived from abundantly available raw materials coupled with the comparative ease of preparing a given chemical species as opposed to preparing complex mixtures thereof with attendant reproducibility problems. There is, however, a drawback to the use of JP-10 in airborne launching operations insofar as it possesses relatively low volatility thereby resulting in an unacceptably high flash point of about 130° F. For the indicated low temperature operations, a flash point of less than 100° F. and preferably substantially less that this value is sought.

The foregoing volatility requirement has been met by a fuel designated JP-9, same being a blend of 65–70 weight percent JP-10, 20–25 weight percent RJ-5 and 10–12 weight percent methylcyclohexane. Methylcyclohexane serves to impart the necessary volatility characteristics to JP-10, so that an acceptable flash point can be realized. However, this low density component is required in an amount which undesirably lowers the volumetric heat of combustion of JP-10. Therefore, it is necessary to include the indicated amount of RJ-5 in order to achieve an overall volumetric heat of combustion in the order of that exhibited by neat JP-10.

As mentioned previously, RJ-5 is the most exotic of the current high density fuels in that it possesses a heat of combustion in excess of 160,000 BTU per gallon. It is, however, by far the most expensive of the high energy fuels due in part to the difficulty in synthesizing the fuel itself and in a larger part due to the short supply of the precursor, norbornadiene, from which it is prepared. It is accordingly the object of the present invention to provide a high density fuel having the heat content and physical properties established for JP-9 but which does not require the use of RJ-5 to extent specified for JP-9.

SUMMARY OF THE INVENTION

In accordance with the present invention, high density composite fuels are provided having the specifications established for JP-9 in respect of heat content, freeze point, viscosity and volatility. The principal component of the contemplated fuels is JP-10 (exo-tetrahydrodicyclopentadiene) which is present in an amount of at least 70 weight percent. The requisite volatility is imparted to the composite fuel by the presence of 1–7 weight percent of a mixture of $C_5$–$C_7$ alkane and/or cycloalkanes. The lowering of the net heat of combustion resulting from the inclusion of said low density component; i.e., said $C_5$–$C_7$ mixture, is offset or compensated for by the presence of from 4–20 weight percent of the hydrogenated dimers of norbornadiene; viz., RJ-5.

DESCRIPTION OF THE PREFERRED EMBODIMENTS

As indicated previously, JP-10 is a commercially available product. However, since the reaction mixture resulting in the preparation of JP-10 is a source of the $C_5$ alkane/cycloalkane mixture constituting an important part of the low boiling component contemplated herein, it will be desirable to comment briefly on the method applicable for producing this fuel. Further details regarding this process can be found in U.S. Pat. No. 3,381,046. The first step involved in that of completely hydrogenating dicyclopentadiene to provide the endo-stereo isomer of the tetrahydro derivative. Generally hydrogenation is carried out in two stages. In the first stage, the 8, 9 positions of the dimerized product are hydrogenated at a temperature generally in the order of about 120° C. The dihydro derivative is relatively thermally stable, thus permitting the use of a substantially higher temperature in the second stage; viz., in the order of about 215° C. Hydrogenation is carried out in the second stage to the extent whereby the resultant tetrahydro derivative exhibits a melting point of at least about 70° C. Hydrogenation pressure conditions range from about 5–15 atmospheres.

In the second step of the process the endo isomer of the tetrahydro derivative is isomerized to the exo form. The crude hydrogenation product or an appropriate distilled fraction thereof, rich in the endo-isomer content, can alternatively be subjected to isomerization in accordance with the prior art. In the context of the present invention, however, it is advantageous to utilize the total crude hydrogenation product in the isomerization reaction. The isomerization is carried out in the presence of a variety of acidic catalysts such as the Brönsted or Lewis acids. The Lewis acids and specifically aluminum chloride, is preferred from the standpoint of inducing a rapid reaction rate. On the other hand, aluminum chloride has a tendency to cause the isomerization to proceed beyond the exo isomer thereby resulting in the objectionable formation of substantial amounts of transdecalin and adamantane. Accordingly, due care must be exercised in the utilization of this catalyst.

The extent of conversion to the exo isomer can be conveniently monitored by vapor liquid gas chromatography. Upon attaining substantially complete conversion; i.e., 98+%, the reaction mixture is cooled to about 80° C. to provide, upon settling, a two-phase system thereby permitting recovery of the fuel from the sludge by decantation. The product is then fractionally distilled to provide a heartcut which consists essentially of the exo isomers. Provided the crude hydrogenation product is employed in carrying out the isomerization reaction as indicated above, a forecut of the isomerization reaction product will be essentially composed of isomeric pentanes with the bulk thereof; i.e., about 70 percent, being cyclopentane. The forecut along with a minor amount of hexanes and heptanes represents an effective volatility component of the composite fuels contemplated herein. Particularly exemplary of such volatility modifiers comprises a mixture of about 60% of said forecut and about equal amounts of isomeric hexanes and heptanes.

EXAMPLE

Illustrative high energy fuel compositions in accordance with this invention together with the relevant properties exhibited thereby are set forth in Table I below. The volatility component of these composite fuels was composed of 60% $C_5$ alkane/cycloalkane mixture (JP-10 forecut) and 20% each of an isomeric mixture of hexanes and a like mixture of heptanes.

TABLE I

| Sample Number | Weight % $C_5$–$C_7$ | Weight % JP-10 | Weight % RJ-5 | Specific Gravity | Flash Point | Viscosity (0° F./−65° F.) | $\Delta H_{Cnet}$ (BTU/lb) |
|---|---|---|---|---|---|---|---|
| A | 1 | 95 | 4 | 0.939 | 94° F. | 8.52/36.31 | 18066 |
| B | 2 | 90 | 8 | 0.9402 | 68° F. | 8.67/37.97 | 18021 |
| C | 3 | 85 | 12 | 0.9427 | 47° F. | 8.77/38.60 | 18123 |
| D | 4 | 80 | 16 | 0.9452 | 36° F. | 9.05/41.75 | 18110* |
| E | 5 | 75 | 20 | 0.9478 | 28° F. | 9.17/43.25 | 18112* |
| F | 2.7 | 90.3 | 7 | 0.9383 | 56° F. | 8.10/34.54 | 18010 |

*calculated

What is claimed is:

1. A high density fuel composition consisting essentially of (a) from 70–95 weight percent of exo-tetrahydrodicyclopentadiene; (b) from 4–20 weight percent of the hydrogenated dimers of norbornadiene; and (c) from 1–7 weight percent of an isomeric mixture of $C_5$–$C_7$ hydrocarbons.

2. A high density fuel composition according to claim 1 wherein the isomeric $C_5$ hydrocarbon mixture of component (c) is present as a major proportion of said component.

3. A high density fuel composition according to claim 2 wherein the isomeric $C_5$ hydrocarbon mixture is composed of a major amount of cyclopentane.

4. A high density fuel composition according to claim 2 or 3 consisting essentially of from 80–90 weight percent (a); from 8–16 weight percent (b); and from 2–4 weight percent (c).

* * * * *